United States Patent [19]

Surti

[11] Patent Number: 4,975,743

[45] Date of Patent: Dec. 4, 1990

[54] PROCESS CARTRIDGE HAVING REMOVABLE DRIVE MEANS

[76] Inventor: Tyrone N. Surti, 424 Harding Industrial Dr., Nashville, Tenn. 37211

[21] Appl. No.: 396,098

[22] Filed: Aug. 21, 1989

[51] Int. Cl.[5] ..... G03G 15/00

[52] U.S. Cl. ..... 355/211; 403/355; 355/210

[58] Field of Search ..... 355/211, 210, 200; 403/355, 356, 358

[56] References Cited

U.S. PATENT DOCUMENTS 4,171,939 10/1979 Harwath ..... 403/355 X
4,344,700 8/1982 Kasama et al. ..... 355/211
4,711,605 12/1987 Hodlewsky ..... 403/355
4,829,335 5/1989 Kanemitsu et al. ..... 355/210 X

*Primary Examiner*—R. L. Moses
*Attorney, Agent, or Firm*—Phillips & Beumer

[57] ABSTRACT

A drive system for rotation of a photosensitive member carried in a removably mountable housing of a process kit used in an image-forming apparatus. The drive system includes a rotatable helical gear loosely carried on a shaft secured to the rotatable photosensitive member. The loosely mounted helical gear is longitudinally movable along the shaft of the photosensitive member and serves to limit any longitudinal movement of the photosensitive drum and thus the process kit housing relative to the image-forming apparatus.

7 Claims, 1 Drawing Sheet

PROCESS CARTRIDGE HAVING REMOVABLE DRIVE MEANS

FIELD OF THE INVENTION

The present invention relates generally to a process kit for image-forming apparatus and more particularly to the driving system for a photosensitive member or drum contained in the process kit.

BACKGROUND OF THE INVENTION

Process cartridges which are detachably mounted in copying apparatus are well known in the art. Some such cartridges are disclosed in U.S. Pat. Nos. 4,588,280; 4,591,258; 4,575,221; and 4,566,777. These cartridges typically include a photosensitive drum rotatably mounted in the cartridge housing, and generally a more or less clearance is provided between the housing or casing in order to allow smooth rotation of the photosensitive drum in the process cartridge housing. Such clearance generally results in a small longitudinal shift of the drum when the photosensitive drum is driven. One manner in which the sideways thrust is created is disclosed in U.S. Pat. No. 4,829,335, wherein longitudinal movement is created by the helical gear, and the cartridge continues to move against the main frame of the image- forming apparatus even after the initial engagement between the cartridge and the main frame. To provide the structure to permit this limited longitudinal movement, the cartridge in U.S. Pat. No. 4,829,335 is provided with a photosensitive drum having a helical gear formed on the annulus of an end member having a central opening therein to receive a shaft which is fixed to and extends from the main assembly of the copying appartaus and into the drum. The end member of the drum and the helical gear is made integral with each other and with the end of the photosensitive drum, and the drum rotates freely on the shaft.

It is, therefore, an object of the present invention to provide a process kit for use in an image-forming apparatus wherein the photosensitive drum in the process cartridge is provided with a gear for rotation thereof, the gear and the photosensitive drum cooperating in such a manner which will prevent frictional contact between the end of the photosensitive drum and the process cartridge housing and the cartridge housing and the main frame of the image-forming apparatus.

SUMMARY OF THE INVENTION

According to an embodiment of the present invention, applicant provides a structure wherein the photosensitive drum is provided with an end member made integral therewith. A helical gear is loosely mounted on the end member and is keyed thereto for longitudinal movement across the end member responsive to the initial rotation of the helical gear and the end member. The keyed gear and end member imparts rotational movement to the drum.

DESCRIPTION OF THE PREFERRED EMBODIMENT

Figure 1:
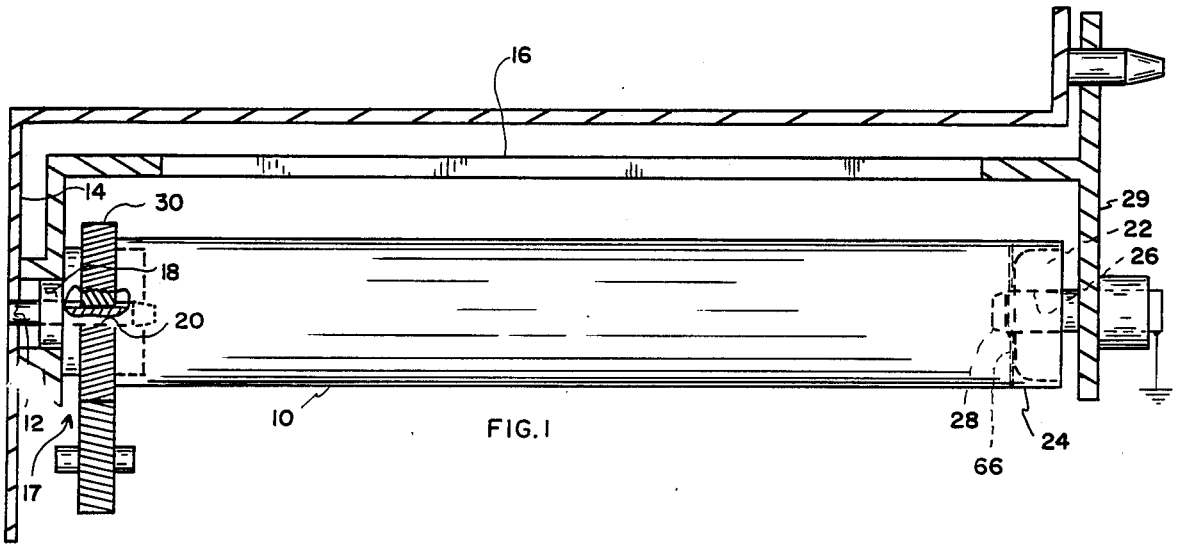
FIG. 1 is a partial longitudinal sectional view illustrating a process cartidge including a rotatable photosensitive drum mounted in an image-forming apparatus.

As seen in FIG. 1, a photosensitive drum 10 is shown rotatably mounted on a shaft 12 affixed to the main frame 14 of a copying apparatus and extending into a processing cartridge housing 16 which is removably carried in the main frame 14. To support the drum at its end 17, an end member 18 having a central shaft receiving opening 20 therein is secured to the drum (as by gluing, etc.) and mounted on shaft 12. A second end member 22 is secured to drum 10 at the opposite end 24 thereof and is provided with a central shaft reciving opening 26 therein to recieve a second shaft 28 extending from an end wall 29 of cartridge housing 16.

Figure 2:
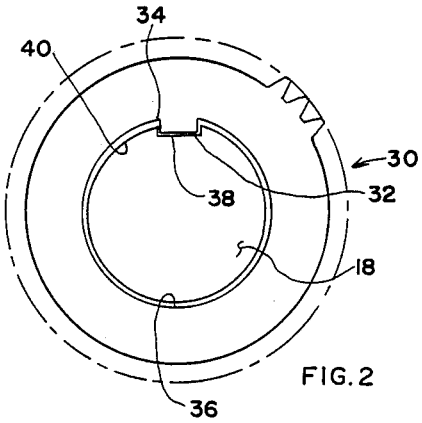
FIG. 2 is an end elevational view illustrating a helical gear mounted on an end member of the photosensitive drum assembly.

To impart rotation to drum 10, a helical gear 30 is mounted on end member 18. Gear 30 includes a projection or key 32 (FIG. 2) extending imwardly from an annular surface 34 which forms a central opening 36 into which end member 18 fits. Key 32 extends into and is loosely received in a slot 38 provided in annular surface 40 of end member 18.

Figure 3:
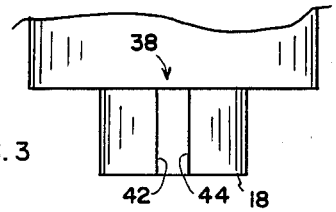
FIGS. 3–8 illustrate various configurations of keyways provided in the end member of FIG. 2 to recieve correspondingly configured keys of the gear of FIG. 2 for mating engagement.
Figure 4:
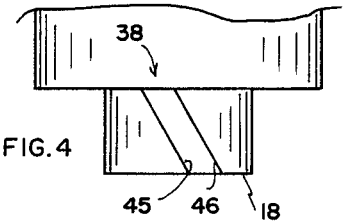
Figure 5:
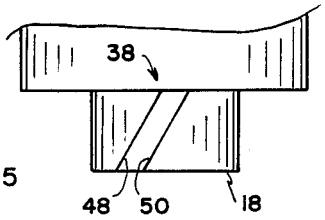
Figure 6:
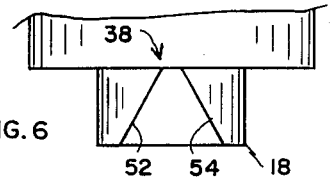
Figure 7:
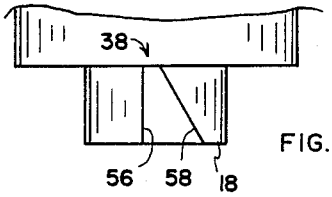
Figure 8:
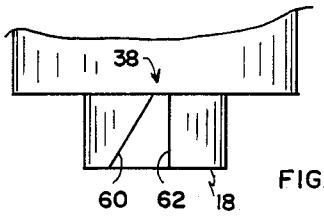

FIGS. 3–8 illustrate various configurations of the keyways. FIG. 3 illustrates a straight slot or keyway 38 with substantially straight, parallel sides 42 and 44 which extend across the width of end member 18. FIG. 4 illustrates an angled slot 38 having substantially parallel sides 45 and 46 which extend in angled relation substantially across the width of end member 18. FIG. 5 illustrates an angled slot 38 having substantially parallel sides 48 and 50 which are angled in the opposite direction from that illustrated in FIG. 4. The angled slots of members 18 shown in FIGS. 4 and 5 provide for either clockwise or counterclockwise rotation of the gear. FIG. 6 illustrates slot 38 as having a pair of sides 52 and 54 which extend across the width of member 18 in converging-diverging relationship. This arrangement provides for key 32 to ride in the slot during clockwise or counterclockwise rotation of the gear. FIG. 7 illustrates slot 38 extending across the width of member 18 and provided with a straight side 56 and an angled side 58. FIG. 8 illustrates slot 38 extending across the width of member 18 and provided with a straight side 60 and an angled side 62 which is angled in a direction opposite to the angled surface of the slot shown in FIG. 7. The slots of member 18 as shown in FIGS. 7 and 8 accommodate clockwise or counterclockwise rotation of the gear.

It is to be understood that while the drawings illustrate projection (key) 32 being on the gear and slot 38 as being on end member 18, these may be reversed, with the projection on member 18 and the key being provided on the gear.

As seen in FIG. 1, grounding spring 66 is shown and provides an electrical ground between the internal surface of the OPC drum and shaft 28. Of course, other types of ground connections may be used, such as making end member 22 of electrically conductive plastic.

It can be seen that the applicant has provided a process cartridge for an image-forming apparatus which utilizes the smooth, efficient operation provided by a helical gear for rotation of a photosensitive drum in the cartridge. The sliding gear arrangement provided by the applicant provides for discarding of the drum once the drum is no longer usable (because of scratches, etc., or because its lifetime has ended) without the necessity of discarding the helical driving gear. Additionally, it should be obvious that as a result of the sliding gear arrangement which prevents longitudinal movement of the drum, frictional contact between the gear and cartridge housing and the cartridge housing and the main frame is substantially eliminated, thus resulting in a more efficient operation of the apparatus.

It is to be understood that while the above description has been directed to rotating an OPC drum of a process cartridge, the invention should not be limited only to such use as, obviously, the structure may be also usable in the rotating mechanism for belt OPC systems. It is to be further understood that the OPC drum substrate may be comprised of metal or conductive plastics.

I claim:

1. A process cartridge for use in an image-forming apparatus comprising:

a housing;

a rotatable photosensitive member carried in said housing;

first and second end support members disposed for support of said photosensitive member at opposite ends thereof, said end support members being rigidly secured to said photosensitive member;

first and second shafts extending respectively into said first and second end support members for rotatably supporting said end support members and said photosensitive member;

a rotatable helical gear slidably mounted on said first end member for longitudinal movement therealong; and limiting means operatively coupled between said first end member and said helical gear to control and limit said movement of said photosensitive member for eliminating frictional contact between said photosensitive drum and said housing said helical gear loosely secured to said end member for rotation therewith to impact rotation to said photosensitive drum, said gear disposed for movement across said end member responsive to rotation of said helical gear.

2. Apparatus as set forth in claim 1 wherein said limiting means includes a keyway slot provided on the periphery of said end member and a projecting member provided on said gear for projecting into said slot.

3. Apparatus as set forth in claim 2 wherein said slot is provided with parallel sides and extends diagonally across the width of said first end member.

4. Apparatus as set forth in claim 2 wherein said slot is provided with parallel sides and extends in angled relation across said first end member.

5. Apparatus as set forth in claim 2 wherein said slot is provided with non-parallel sides and extends across the width of said first end member.

6. Apparatus as set forth in claim 5 wherein said non-parallel sides are disposed in a converging-diverging relation across the width of said first end member.

7. A process cartridge for use in an image-forming apparatus comprising:

a housing;

a rotatable photosensitive member carried in said housing;

first and second end support members disposed for support of said photosensitive member at oppposite ends thereof, said end support members being rigidly secured to said photosensitive member, said first end support member including an annular portion having a slot extending across the width thereof;

first and second shafts extending respectively into said first and second end support members for rotatably supporting said end support members and said photosensitive member; and a rotatable helical gear mounted on said annular portion of said first end member for longitudinal movement therealong, said helical gear hoving an internal annular surface provided with a projecting member extending therefrom and into said slot of said first end support member, whereby, responsive to rotation of said helical gear, said gear is made to move longitudinally across said width of said annular portion while imparting rotation of said drum and while limiting any longitudinal movement of said photosensitive member.

* * * * *